US008087210B2

(12) United States Patent
Agneloni

(10) Patent No.: US 8,087,210 B2
(45) Date of Patent: Jan. 3, 2012

(54) METHOD FOR REINFORCING BUILDING STRUCTURES AND COATING OBTAINED THEREBY

(75) Inventor: Emo Agneloni, San Mariano (IT)

(73) Assignee: Tec. Inn S.r.l., San Mariano (PG) (IT)

( * ) Notice: Subject to any disclaimer, the term of this patent is extended or adjusted under 35 U.S.C. 154(b) by 688 days.

(21) Appl. No.: 11/631,510

(22) PCT Filed: Feb. 10, 2006

(86) PCT No.: PCT/IT2006/000070

§ 371 (c)(1),
(2), (4) Date: Oct. 21, 2008

(87) PCT Pub. No.: WO2006/087751

PCT Pub. Date: Aug. 24, 2006

(65) Prior Publication Data

US 2009/0044476 A1 Feb. 19, 2009

(30) Foreign Application Priority Data

Feb. 17, 2005 (IT) ..... RM2005A0066

(51) Int. Cl.
*E04B 1/00* (2006.01)

(52) U.S. Cl. ..... 52/741.3; 52/516; 156/71

(58) Field of Classification Search ..... 52/514, 52/514.5, 515, 516, 517, 741.3, 746.1; 156/71, 156/91, 293

See application file for complete search history.

(56) References Cited

U.S. PATENT DOCUMENTS

| | | | | |
|---|---|---|---|---|
| 4,875,322 | A * | 10/1989 | Rozzi | 52/746.1 |
| 5,409,564 | A * | 4/1995 | Aaldijk | 156/71 |
| 5,649,398 | A * | 7/1997 | Isley et al. | 52/309.17 |
| 7,311,964 | B2 * | 12/2007 | Aldea et al. | 428/297.4 |
| 7,829,149 | B2 * | 11/2010 | Kim et al. | 427/412 |
| 2004/0129365 | A1 * | 7/2004 | Buckwalter et al. | 156/71 |
| 2005/0181183 | A1 * | 8/2005 | Pacey | 428/195.1 |

FOREIGN PATENT DOCUMENTS

| | | |
|---|---|---|
| DE | 20 2004 009680 | 9/2004 |
| EP | 1 258 579 | 11/2002 |
| FR | 2 400 096 | 3/1979 |

* cited by examiner

*Primary Examiner* — Brian Glessner
*Assistant Examiner* — Adam Barlow
(74) *Attorney, Agent, or Firm* — Young & Thompson

(57) ABSTRACT

A method for reinforcing building structures enables to obtain a reinforcing coating through the steps of: anchoring resistant film (2) of composite material to a building structure (s) to be reinforced and superposing onto the resistant film (2) an elastic film (8) at least partially uncoupled from the resistant film (2), in such a way that the elastic film (8) can be deformed and slide tangentially relative to the resistant film (2).

28 Claims, 3 Drawing Sheets

METHOD FOR REINFORCING BUILDING STRUCTURES AND COATING OBTAINED THEREBY

TECHNICAL FIELD

Figure 1:
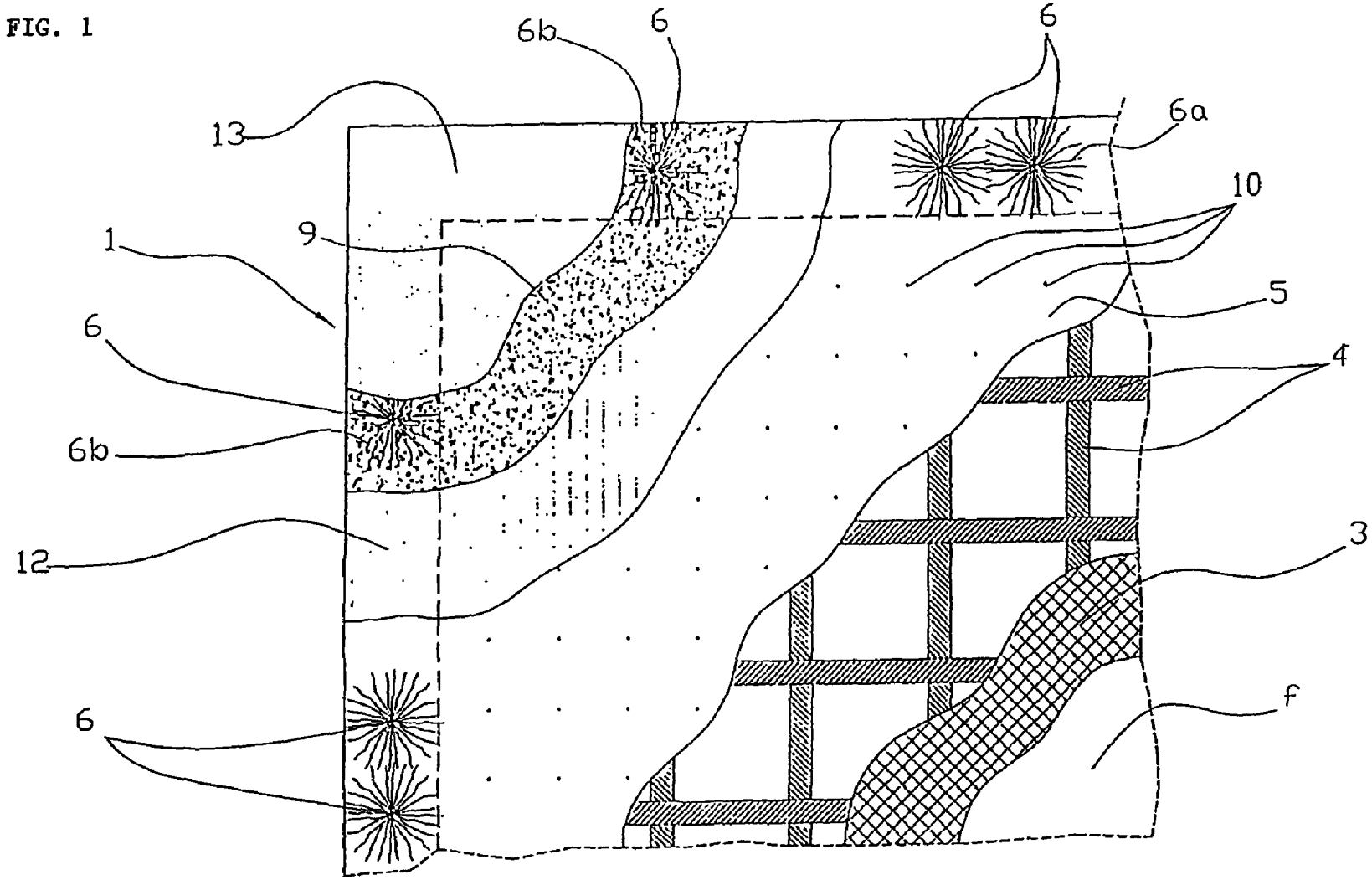

The present invention relates to a method for reinforcing building structures and a coating obtained thereby. The term "building structures" generically construed includes not only civil buildings, but also industrial buildings, infrastructures, such as bridges, viaducts and tunnels, the structural elements of construction, historical-artistic and monumental assets, etc.

In particular, the present invention is applied in the field of the structural reinforcement of construction assets exhibiting structural deficiencies due to time-induced decay or to any other cause, such as an increase in loads or exceptional events, such as earthquakes or explosions caused, for example, by gas leaks.

BACKGROUND ART

The use of composites, known by the English acronym FRP (Fibre Reinforced Polymer) is known for structural reinforcement in engineering and architecture, applied to civil and industrial buildings and infrastructures such as bridges, viaducts and galleries. An example of this application is given in the patent No. IT1298946 which discloses a consolidation method consisting of the application of a single layer of composite substance on a structural element to be reinforced. The composite is obtained by depositing a layer of resin which adheres to the structural element and whereon is laid a unidirectional or multi-axial fabric, dry pre-impregnated, e.g. carbon fibre, glass fibre or aramid fibre. Lastly, on the impregnated fabric is applied additional resin to complete the impregnation of the fabric and assure its final gluing.

While the known methods briefly described above allow to reinforce the buildings statically even after a partial structural collapse, they are not able to perform a preventive action. In other words, such methods cannot assure the absorption of energy and contain the detachment of portions of the structure during or immediately after the occurrence of an exceptional event, such as an explosion or an earthquake. All resin layers are integrally connected to the strong structure of the reinforcement structure where the fibre, which has high ultimate tensile strength but modest elongation values, in the order of 1-3%. Therefore, an impulsive destructive events, such as the one due to seismic shocks, of such intensity as to break the fibre, causes the simultaneous tearing of the fibres and of the resins anchored to them by impregnation, and hence of the connection to the structure subjected to the intervention.

DISCLOSURE OF THE INVENTION

An object of the present invention is to solve the problems noted in the prior art, proposing and method and a coating for reinforcing building structures, able to overcome the aforementioned drawback.

In particular, an object of the present invention is to propose a method for obtaining a coating to reinforce building structures which, applied also on undamaged structures, prevents the detachment of parts of the building and the collapse of the building itself due to destructive impulsive events, thus serving a preventive function.

Another object of the present invention is to propose a method for reinforcing building structures that allows to suit the structure of the coating obtained around the building to the specific requirements encountered in each case.

An object of the present invention is also to propose a method for reinforcing building structures that also allows, like known methods, making buildings safe and repairing them after the partial collapse due to time-induced decay, and to an increase in loads or to exceptional events.

DESCRIPTION OF THE ILLUSTRATIVE EMBODIMENT

These objects and others besides, which shall become more readily apparent from the description that follows, are substantially achieved by a method for reinforcing building structures comprising the characteristics expressed in one or more of the claims 1 through 18 and a coating, obtained from said method in accordance with claims 19 through 29.

Figure 2:
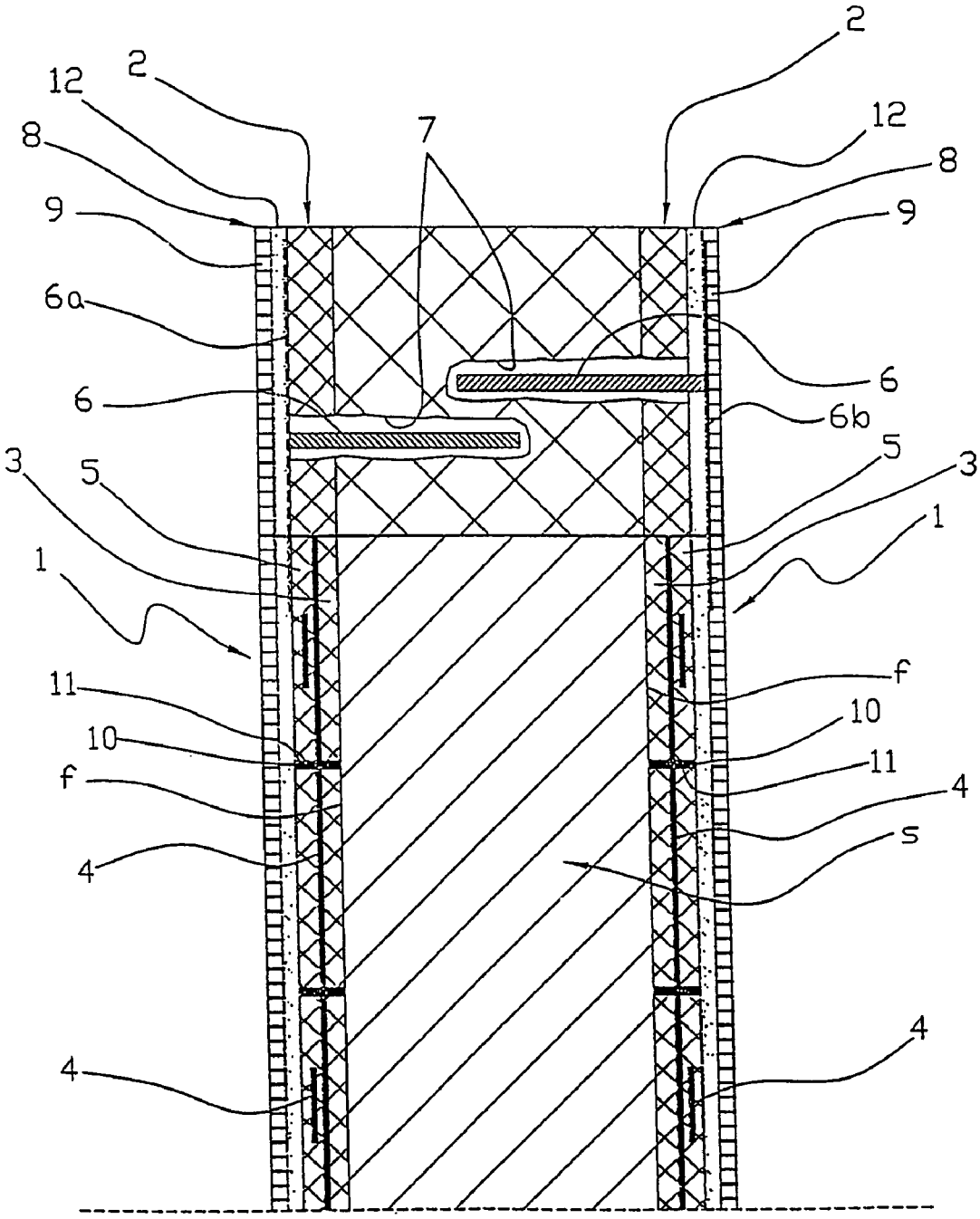
Figure 3:
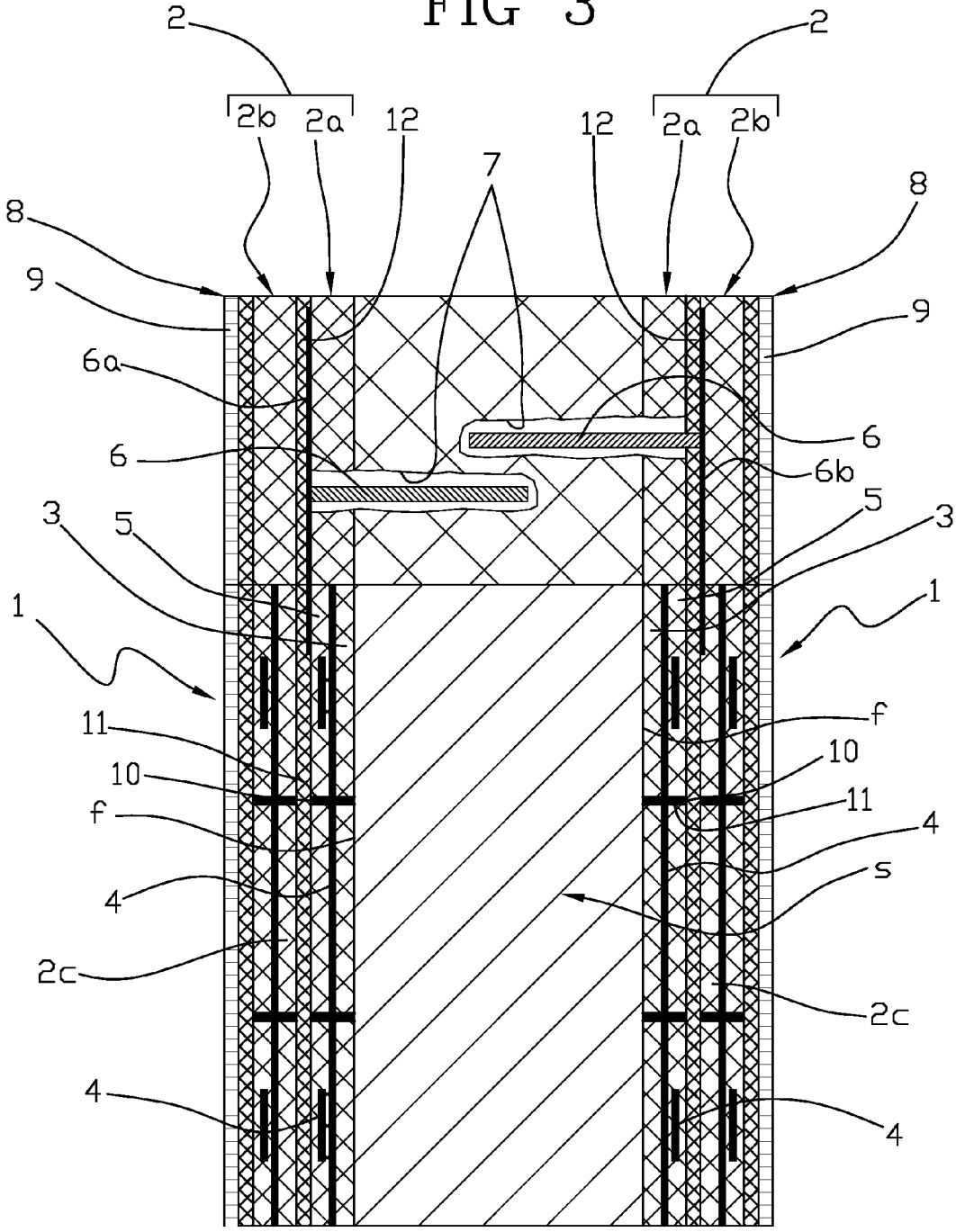

Further characteristics and advantages shall become more readily apparent from the detailed description of a preferred, but not exclusive, embodiment of a method for reinforcing building structures and a related coating in according with the present invention. Said description will be exposed below with reference to the accompanying figures, provided merely by way of non limiting indication, in which:

FIG. 1 shows a plan view of a coating according to the present invention applied on a structure to be reinforced, with some parts removed the better to highlight others; and FIG. 2 shows a cross section view of the coating and of the structure of FIG. 1; and FIG. 3 shows a cross section view of the coating and of the structure of FIG. 1 according to a different embodiment.

With reference to the accompanying drawings, the number 1 globally indicates a coating for reinforcing building structures in accordance with the present invention. The coating 1 can, for example, be applied on the outer and/or inner faces, or to the interior, of the perimeter and/or inner walls of a building, on the ceilings, on the dividing walls, wound around to envelop pillars, beams, or parts thereof, or to structural elements in general. The structure can be made of any material, e.g. reinforced concrete, pre-compressed reinforced concrete, masonry (stone, bricks, tufa, mixed or other material), wood, steel (plugged in masonry or with concrete panels) or of pultruded composite. In FIG. 2, the building structure "s" is represented by way of example by a sectioned wall provided with a coating 1 according to the invention applied on each of its faces "f".

After performing an experimental analysis on the structures and on the base, to define the compatible materials to be used to anchor the reinforcing coating and after verifying with experimental and/or numeric models the behaviour of the structure, or of parts thereof, under the application of external forces, it is necessary to design the local or global reinforcement system and to define the required reinforcing structures. Hence, the first step of the method of the invention consists of anchoring a resistant film 2 made of composite material to the building structure "s".

Said first step if carried out applying on the face "f" an anchoring layer 3 constituted by the aforementioned compatible material which is preferably two-component epoxy resin, cement mortar, natural mortar, polyurethane or polyurea. The selection of the most appropriate material is dictated by the compatibility with the base and by the maturing times which are influenced by the conditions and by the temperature of the base and of the environment. Such times must preferably range between 12 and 48 hours, in order to allow the subsequent application and the partial burying of a resistant structure 4 in the anchoring layer 3 with the necessary accuracy and skill. For this purpose, if polyurethane or polyurea is used they will preferably be thixotropic and with delayed maturation. Moreover, if the selected material allows it, the anchoring layer 3 is applied by spraying. Spray delivery enables to speed up operations and to preserve the material at controlled pressure and temperature in such a way as to prevent it from maturing in too short or too long a time interval and in any case one that is not compatible with application requirements.

The resistant structure 4, shown by way of example in FIG. 1 with crossed bands, comprises filaments of a resistant material, such as carbon fibre, steel, aramid or glass, preferably arranged as a mesh or defining a fabric. The section of the filaments, their arrangement, the weave and the orientation are chosen for each specific application based on the calculation models and to the size of the load and of the stresses they have to withstand and to the deformations they have to allow, in order to absorb and dissipate part of the energy at play.

To complete the resistant film 2 as shown in the accompanying figures, a closing layer 5 is lastly applied onto the resistant structure 4, which completes the impregnation of the resistant structure 4 and serves the purpose of completing its anchoring.

The closing layer 5 is applied by spraying an elastic material, like quick-maturing polyurca or polyurethane, which has the characteristic of being applicable rapidly without environmental constrains and which matures within three, five seconds.

Advantageously, the anchoring of the resistant film 2 to the building structure "s" is completed by means of a plurality of bars 6 each connected to the resistant film itself 2 and inserted in a respective anchoring hole 7 drilled in the building structure "s" (FIG. 2, bar 6 on the left). The bars 6, known in themselves, are of the type that is partly rigid and partly to be impregnated with one of the materials forming the resistant film 2. In particular, if the building structure "s" is made of reinforced concrete or of steel with masonry coating, the holes 7 are drilled on the frame, respectively made or reinforced concrete or of steel. If the building structure "s" is made of load-bearing masonry, the holes 7 are executed on the orthogonal wall tenons and on the orienting devices.

Each of the bars 6 is formed by a reel of wires, preferably constituted by glass, aramid or carbon, buried for about two thirds of their length in the epoxy resin. The impregnated and rigid part is inserted in the hole 7 and anchored to the structure by means of the same resin, whilst the free wires 6*a* remain outside, in order to be impregnated and anchored in one of the layers that form the resistant film 2. For this purpose, the projecting part to be impregnated 6*a* must be free and well distributed (e.g. in 360° flower shaped viewed in plan view), as shown in FIG. 1.

In accordance with the method of the invention, the coating is completed by the step of superposing to the resistant film 2 an elastic film 8 in such a way that the elastic film is at least partially uncoupled from the resistant film 2 and is able to be deform and slide tangentially relative to the resistant film 2 itself by effect of the deformations undergone by the building structure "s" as a result, for example, of seismic stresses.

The elastic film 8 shown in the accompanying figures is obtained by depositing, preferably by spraying, a single layer 9 of elastic material, such as polyurea or polyurethane.

To allow the mutual sliding between the resistant film 2 and the elastic one 8, the elastic film 8 is coupled to the resistant film 2 only at a discrete number of points 10. Said coupling is performed by drilling a plurality of holes 11 in the resistant film 2 before applying the elastic film 8 and filling the holes 11 with the material of the elastic layer 9 of said elastic film 8. This type of connection allows small relative sliding motions thanks to the elasticity of the material that fills the holes 11 and allows more sizeable movements once the deformation of the building structure causes the rupture of said point-like connections.

Preferably, moreover, a falsework removal compound 12 is applied between the resistant film 2 and the elastic film 8, to facilitate the tangential sliding of one relative to the other, taking care to protect the holes 11 to prevent them from filling with said material. In FIG. 2, the thickness of the falsework removal compound 12 was purposely exaggerated for the sake of clarity.

The depth of the holes 11, their diameter and their number per square meter as well as the type of removal compound 12 will be selected based on the adhesion characteristics to be obtained. By way of example, the holes 11 can have a diameter ranging between 5 mm and 2 or 3 cm, with a depth ranging between 2 and 5 mm and a numeric density for example from 4 to 100 per square meter. The falsework compound 12, also preferably applied by spraying, may be surface-active silicone, acrylic resin, polyvinyl butyrate or invisible adhesive or other suitable material.

Preferably, according to a scheme not shown herein, the elastic film 8 is obtained applying in superposition a plurality of elastic layers connected to each other in controlled fashion with falsework removal compounds and holes, as described above for the connection between the resistant film 2 and the sole elastic layer 9. Relative to the resistant film 2, the layers of the elastic film 8 are not reinforced with resistant structures but are preferably constituted by polyurea or polyurethane with a thickness ranging between 2 and 6 mm and with a very high ultimate elongation (from 100% to 500%). Preferably moreover, each outer elastic layer has greater ultimate elongation that the contiguous inner elastic layer.

Advantageously, the anchoring of the elastic film 8 to the building structure "s" is completed by means of a plurality of bars 6 of the type described above for anchoring the resistant film 2. Each bar 6 is connected to the elastic film 8 and inserted in a respective anchoring hole 7 drilled both in the building structure "s" and in the resistant film 2. The free wires 6*b* remain outside the hole 7 and are impregnated with the material of one of the layer that form the elastic film 8 (FIG. 2, bar 6 on the right).

The coating can be completed by a finishing layer 13 of plaster, primer or paint shown only in FIG. 1.

In the embodiment shown in the accompanying figures and described heretofore, the resistant film 2 consists of a single resistant layer that comprises the anchoring layer 3, the closing layer 5 and the resistant film 4.

In an embodiment variant, shown in FIG. 3, the resistant film 2 is formed by a plurality of resistant layers that are manufactured according to the stresses at play and to specific design requirements.

In this situation, the closing layer 5 together with the anchoring layer 3 and with the resistant structure 4 described above define a main resistant layer 2*a* directly associated to the building structure "s". To said main resistant layer 2*a* are superposed one or more auxiliary resistant layers 2*b* which, together with the main one 2*a*, globally constitute the resistant film 2. The resistant layers, too, are connected to each other in controlled fashion with falsework removal compounds and holes, as described above for the connection between the resistant film 2 and the illustrated sole elastic layer 9, in order to facilitate the mutual tangential sliding.

The holes are filled with the material of the fastening layer 2*c* of the contiguous and upper auxiliary resistant layer 2*b*, in such a way as to define a discrete number of connecting points.

Based on the global characteristics of the coating, the resistance and the elasticity of the resistant layers can be equal or differentiated. Preferably, each outer resistant layer will be more elastic than the inner contiguous layer. In particular, the laying of a first auxiliary resistant layer 2*b* on the main one comprises the step of drilling holes with sufficient depth to overcome the main resistant layer 2*a* and reach the face "f" of the building structure "s". The dimensions and the number of the holes have the values specified above with reference to the embodiment illustrated in the accompanying figures.

Also provided are anchorings of the auxiliary resistant layer 2*b* to the building structure "s" using the same system with bars and holes used for the main layer. The bars used to anchor the auxiliary resistant layer 2*b* in this case also traverse the main resistant layer 2*a*.

Subsequently, a falsework removal compound is applied on the main resistant layer 2*a*, taking care to protect the holes to prevent them from filling with this material. The procedures and the materials selected for the compound are preferably the same ones indicated above for the compound applied between the sole elastic layer 9 and the sole main resistant layer 2, as shown in the accompanying figures.

At this point, a fastening layer 2*c* is deposited which penetrates the holes of the main layer, to obtain a discrete number of connecting points, and it impregnates the free parts of fabric or filament of each bar which remain outside the respective hole drilled in the building structure "s". The fastening layer 2*c* is made of polyurethane or polyurea, preferably thixotropic and with delayed maturation, it is advantageously applied by spraying and it has a thickness of between 2 and 6 mm.

A resistant structure is at least partially buried in the fastening layer 2*c* and lastly a closing layer is applied.

The resistant structure comprises filaments of a resistant material, such as carbon fibre, steel, aramid or glass, preferably arranged in a mesh pattern or defining a fabric. The section of the filaments, their arrangement, the weave and the orientation are chosen for each specific application based on the size of the load they have to withstand and the deformations they have to allow, in order to absorb part of the energy at play.

The closing layer is polyurethane or polyurea, preferably of the rapidly maturing type, it is advantageously applied by spraying and its thickness ranges between 2 and 6 mm.

The fastening layer 2*c*, the closing layer and the resistant structure form the auxiliary resistant layer 2*b* which lies superposed to the main resistant layer 2*a*. The main resistant layer 2*a* and the auxiliary one 2*b* define, together, the resistant film 2.

Preferably, the material and/or the arrangement of the filaments adopted for the resistant structure of the auxiliary resistant layer 2*b* provide said layer with a greater degree of elasticity than the main resistant layer 2*a*.

The coating obtained is therefore constituted by one or more parts (resistant film) anchored to the building structure and able to withstand actions, such as seismic or events or explosions, and by one or more parts (elastic film) which have considerable elasticity. The elastic parts are fastened, in controlled fashion by means of holes and falsework removal compounds, to each other and to the resistant parts and, through the bars 6, directly to the structure to be reinforced.

The invention achieves important advantages.

First of all the method of the invention allows to obtain a coating able to prevent the catastrophic effects due to the collapse of a structure. The coating of the invention can withstand destructive impulsive events, by absorption of energy apportioned between the different resistant and elastic layers, and also totally protect from the collapse/detachment of portions of the structure to be reinforced. The resistant structures progressively absorb at least part of the initial impulse. If the intensity of the event is such as to cause the rupture of all resistant layers, the elastic film is in any case capable of absorbing the energy not yet dissipated making the various elastic layer intervene in succession, in order to dissipate the energy progressively and to involve the $n^{th}$ layer, still whole, that serves a containment function.

Moreover, the modularity of the obtained coating allows to adapt its characteristics of resistance and elasticity to each specific situation.

The method also enables to repair buildings after a partial structural collapse, for example as a result of an earthquake, or to reinforce them as needed as a result of a change in loads, due for instance to a change in the intended use of the building.

Lastly, the method of the invention enables, in particular by applying spray under pressure, to manufacture the coating also on ample surfaces in short times.

The invention claimed is:

1. A method for reinforcing building structures, comprising the step of anchoring a resistant film (2) of composite material to a building structure (s) to be reinforced and the step of superposing to said resistant film (2) an elastic film (8) at least partially uncoupled from said resistant film (2), so that said elastic film (8) can be deformed and slide tangentially relative to the resistant film (2), wherein the step of anchoring the resistant film (2) to the building structure (s) comprises the steps of:

applying a layer of anchoring (3) to the building structure (s), at least partially bury a resistant structure (4) in the anchoring layer (3), applying a closing layer (5) on the resistant structure (4), in order to define a main resistant layer directly coupled to said building structure (s), wherein the step of anchoring the resistant film (2) to the building structure (s) further comprises the steps of:

applying a fastening layer (2*c*) on the main resistant layer (2*a*), at least partially burying another resistant structure (4) in the fastening layer (2*c*), and applying another closing layer (5) on the another resistant structure (4), to define an auxiliary resistant layer (2*b*) superposed to the main resistant layer (2*a*) and defining, together with said main resistant layer (2*a*), said resistant film (2), wherein the method further comprises the step of applying a falsework removal compound (12) between the main resistant layer and the auxiliary resistant layer, in order to facilitate a tangential sliding between said main resistant layer and said auxiliary resistant layer.

2. Method as claimed in claim 1, wherein the elastic film (8) is coupled to the resistant film (2) at a discrete number of points (10).

3. Method as claimed in claim 1, further comprising the step of applying a falsework removal compound (12) between the resistant film (2) and the elastic film (8), to facilitate the tangential sliding of one relative to the other.

4. Method as claimed in claim 1, comprising the steps of applying in superposition a plurality of auxiliary resistant layers defining, together with said main resistant layer, said resistant film (2).

5. Method as claimed in claim 1, wherein the step of anchoring the elastic film (8) to the building structure (s) to be reinforced comprises the steps of: drilling a plurality of holes (7) in the building structure (s) and in the resistant film (2), inserting into each of said holes (7) a respective bar (6) and connecting said bar (6) to the elastic film (8).

6. Method as claimed in claim 1, wherein the step of superposing the elastic film (8) onto the resistant film (2) comprises the step of applying on said resistant film (2) at least one layer (9) of elastic material.

7. Method as claimed in claim 6, wherein the step of superposing the elastic film (8) onto the resistant film (2) comprises the step of drilling a plurality of holes (11) in the resistant film (2) before applying the elastic film (8) and filling said holes (11) with a material of the elastic layer (9) of said elastic film (8), to define a discrete number of connecting points (10).

8. Method as claimed in claim 6, comprising the steps of applying in superposition a plurality of elastic layers defining the elastic film (8).

9. Method as claimed in claim 1, wherein said anchoring layer (3) is applied by spraying.

10. Method as claimed in claim 1, wherein said fastening layer is applied by spraying.

11. Method as claimed in claim 1, wherein said closing layer (5) is applied by spraying.

12. Method as claimed in claim 6, wherein said at least one layer of elastic material (9) is applied by spraying.

13. Coating for reinforcing building structures obtained in accordance with claim 1.

14. Coating as claimed in claim 13, wherein the anchoring layer (3) is selected from the group consisting of epoxy resin, cement mortar, natural mortar, polyurethane and polyurea.

15. Coating as claimed in claim 13, wherein the fastening layer is of polyurethane or polyurea.

16. Coating as claimed in claim 14, wherein the polyurethane and the polyurea are of the thixotropic type and with delayed maturing.

17. Coating as claimed in claim 13, wherein the closing layer (5) is of polyurethane or polyurea.

18. Coating as claimed in claim 17, wherein the polyurethane and the polyurea are of the rapid maturing type.

19. Coating as claimed in claim 13, wherein the resistant structure (4) comprises filaments of a resistant material selected from the group consisting of carbon fibre, steel, aramid and glass.

20. Coating as claimed in claim 13, wherein the resistant structure (4) is a mesh or a fabric.

21. Coating for reinforcing building structures obtained in accordance with claim 6, wherein the elastic material is polyurethane or polyurea.

22. Coating for reinforcing building structures obtained in accordance with claim 5, wherein the bars (6) are of the type that is partly rigid and partly to be impregnated with a material of the elastic film (2).

23. Building structure comprising a coating as claimed in claim 13.

24. A method for reinforcing building structures, comprising the step of anchoring a resistant film (2) of composite material to a building structure (s) to be reinforced and the step of superposing to said resistant film (2) an elastic film (8) at least partially uncoupled from said resistant film (2), so that said elastic film (8) can be deformed and slide tangentially relative to the resistant film (2), wherein the step of anchoring the resistant film (2) to the building structure (s) comprises the steps of:

applying a layer of anchoring (3) to the building structure (s), at least partially bury a resistant structure (4) in the anchoring layer (3), applying a closing layer (5) on the resistant structure (4), in order to define a main resistant layer (2*a*) directly coupled to said building structure (s), wherein the step of anchoring the resistant film (2) to the building structure (s) further comprises the steps of:

applying a fastening layer on the main resistant layer, at least partially burying another resistant structure in the fastening layer, applying a closing layer on the another resistant structure, to define an auxiliary resistant layer superposed to the main resistant layer and defining, together with said main resistant layer, said resistant film (2), wherein the method further comprises the steps of applying in superposition a plurality of auxiliary resistant layers defining, together with said main resistant layer, said resistant film and further comprises the step of applying a falsework removal compound between each auxiliary resistant layer and the next one, in order to facilitate a mutual tangential sliding.

25. A method for reinforcing building structures, comprising the step of anchoring a resistant film (2) of composite material to a building structure (s) to be reinforced and the step of superposing to said resistant film (2) an elastic film (8) at least partially uncoupled from said resistant film (2), so that said elastic film (8) can be deformed and slide tangentially relative to the resistant film (2), wherein the step of anchoring the resistant film (2) to the building structure (s) comprises the steps of:

applying a layer of anchoring (3) to the building structure (s), at least partially bury a resistant structure (4) in the anchoring layer (3), applying a closing layer (5) on the resistant structure (4), in order to define a main resistant layer directly coupled to said building structure (s), wherein the step of anchoring the resistant film (2) to the building structure (s) further comprises the steps of:

applying a fastening layer on the main resistant layer, at least partially burying another resistant structure in the fastening layer, applying a closing layer on the another resistant structure, to define an auxiliary resistant layer superposed to the main resistant layer and defining, together with said main resistant layer, said resistant film (2), wherein the step of anchoring the resistant film (2) to the building structure (s) to be reinforced further comprises the steps of drilling a plurality of holes in the main resistant layer before applying the auxiliary resistant layer and filling said holes with a material of the fastening layer of said auxiliary resistant layer, to define a discrete number of connecting points.

26. A method for reinforcing building structures, comprising the step of anchoring a resistant film (2) of composite material to a building structure (s) to be reinforced and the step of superposing to said resistant film (2) an elastic film (8) at least partially uncoupled from said resistant film (2), so that said elastic film (8) can be deformed and slide tangentially relative to the resistant film (2), wherein the step of anchoring the resistant film (2) to the building structure, (s) comprises the steps of:

applying a layer of anchoring (3) to the building structure (s), at least partially bury a resistant structure (4) in the anchoring layer (3), applying a closing layer (5) on the resistant structure (4), in order to define a main resistant layer directly coupled to said building structure (s), wherein the step of anchoring the resistant film (2) to the building structure (s) further comprises the steps of:

applying a fastening layer on the main resistant layer, at least partially burying another resistant structure in the fastening layer, applying a closing layer on the another resistant structure, to define an auxiliary resistant layer superposed to the main resistant layer and defining, together with said main resistant layer, said resistant film (2), wherein the method further comprises the steps of applying in superposition a plurality of auxiliary resistant layers defining, together with said main resistant layer, said resistant film, and wherein the step of anchoring the resistant film (2) to the building structure (s) further comprises the steps of drilling a plurality of holes in the auxiliary resistant layer before applying a contiguous and upper auxiliary resistant layer and of filling said holes with a material of the fastening layer of said auxiliary contiguous and upper resistant layer, to define a discrete number of connecting points.

27. A method for reinforcing building structures, comprising the step of anchoring a resistant film (2) of composite material to a building structure (s) to be reinforced and the step of superposing to said resistant film (2) an elastic film (8) at least partially uncoupled from said resistant film (2), so that said elastic film (8) can be deformed and slide tangentially relative to the resistant film (2), wherein the step of superposing the elastic film (8) onto the resistant film (2) comprises the step of applying on said resistant film (2) at least one layer (9) of elastic material and the step of drilling a plurality of holes (11) in the resistant film (2) before applying the elastic film (8) and filling said holes (11) with a material of the elastic layer (9) of said elastic film (8), to define a discrete number of connecting points (10).

28. Coating for reinforcing building structures obtained by a method performing the following steps:

anchoring a resistant film (2) of composite material to a building structure (s) to be reinforced;

superposing to said resistant film (2) an elastic film (8) at least partially uncoupled from said resistant film (2), so that said elastic film (8) can be deformed and slide tangentially relative to the resistant film (2), and applying a falsework removal compound (12) between the resistant film (2) and the elastic film (8), to facilitate the tangential sliding of one relative to the other, wherein the falsework removal compound (12) is selected from the group consisting of surface-active silicone, acrylic resin, polyvinyl butyrate and invisible adhesive.

* * * * *